US008536495B2

(12) United States Patent
Lako

(10) Patent No.: US 8,536,495 B2
(45) Date of Patent: Sep. 17, 2013

(54) DEVICE FOR REGULATED WATER HEATING USING THE ENERGY GAINED BY PHOTOVOLTAIC CELLS

(76) Inventor: Daniel Lako, Puchov (SK)

( * ) Notice: Subject to any disclaimer, the term of this patent is extended or adjusted under 35 U.S.C. 154(b) by 99 days.

(21) Appl. No.: 13/172,057

(22) Filed: Jun. 29, 2011

(65) Prior Publication Data

US 2012/0000902 A1 Jan. 5, 2012

(30) Foreign Application Priority Data

Jun. 30, 2010 (SK) ..... 83-2010 U
Oct. 1, 2010 (SK) ..... 142-2010 U

(51) Int. Cl.
*H05B 1/02* (2006.01)

(52) U.S. Cl.
USPC ..... 219/494; 219/497; 219/519; 219/517; 219/508; 392/498

(58) Field of Classification Search
CPC ..... H05B 1/02
USPC ..... 219/494, 497, 501, 505, 507, 508; 392/498, 497
See application file for complete search history.

(56) References Cited

U.S. PATENT DOCUMENTS

| | | | | |
|---|---|---|---|---|
| 7,706,671 | B2 * | 4/2010 | Brown | 392/498 |
| 8,245,987 | B2 * | 8/2012 | Hazzard et al. | 248/213 |
| 2003/0026604 | A1 * | 2/2003 | Hollyday et al. | 392/497 |
| 2010/0133258 | A1 * | 6/2010 | Fima | 219/482 |
| 2012/0187106 | A1 * | 7/2012 | Ashkenazy | 219/438 |

* cited by examiner

*Primary Examiner* — Mark Paschall
(74) *Attorney, Agent, or Firm* — Blank Rome LLP

(57) ABSTRACT

Direct current power gained by photovoltaic cells can be used for heating water in a boiler. Simple installation allows use for domestic or industrial purposes, with a minimal impact to building construction. At the time of lack of sunlight intensity, water heating is provided by gas, or other heating source, or by use of a heating coil supplied by alternating current for that heating. When sunlight intensity is high, the photovoltaic cells of the present invention can be used alone. However, the source of the direct current has to be properly dimensioned in dependence on the volume of the boiler. An output 1 kWh of the source of the direct current gained by photovoltaic cells can be used to heat water of a volume of 100 L.

5 Claims, 1 Drawing Sheet

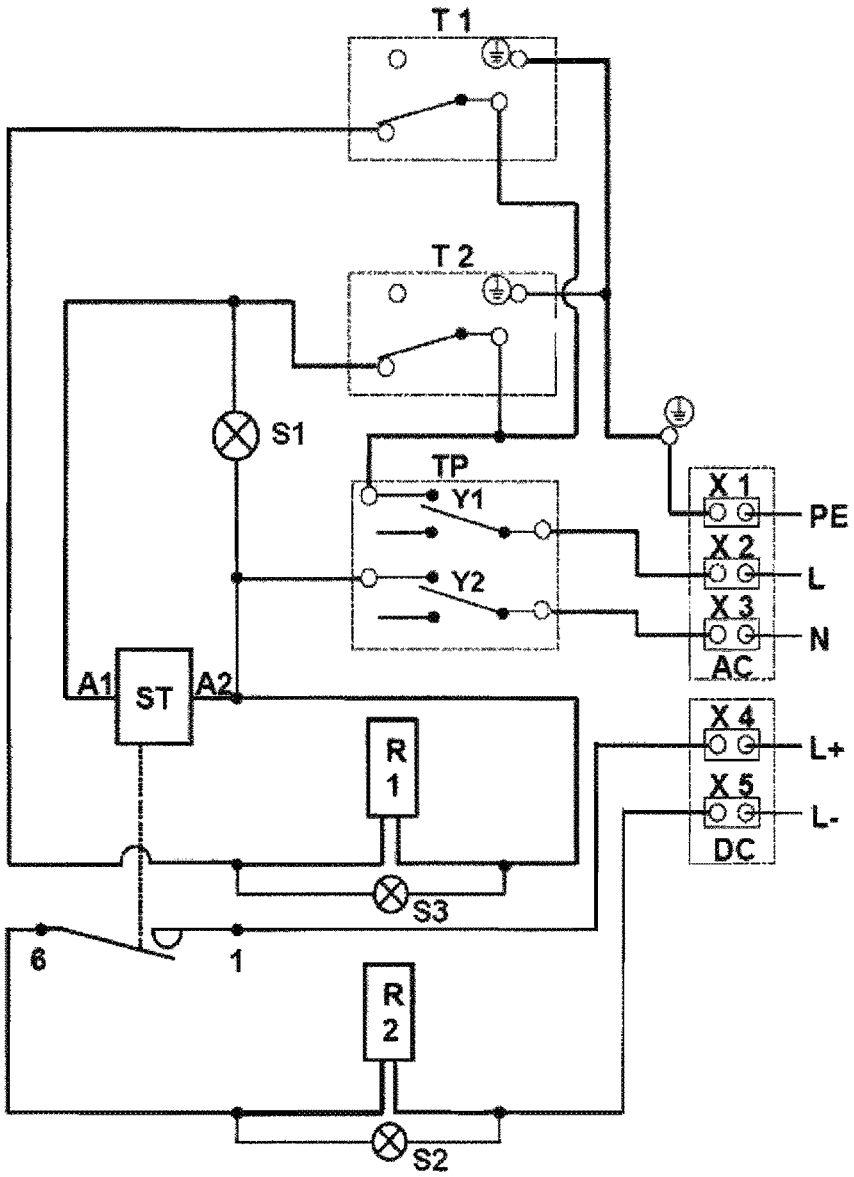
T 1
T 2
S1
TP
Y1
Y2
X 1
X 2
X 3
AC
PE
L
N
A1
ST
A2
R
1
X 4
X 5
DC
L+
L-
S3
6
1
R
2
S2

DEVICE FOR REGULATED WATER HEATING USING THE ENERGY GAINED BY PHOTOVOLTAIC CELLS

RELATED APPLICATION

This application claims benefit of priority of Slovak Republic Patent Application No. PUV 83-2010, filed Jun. 30, 2010; and of Slovak Republic Patent Application No. PUV 142-2010, filed Oct. 1, 2010, each under 35 USC 119(a). All of the above-identified related applications are incorporated herein by reference.

BACKGROUND OF THE INVENTION

The invention concerns the use of the direct current power gained by photovoltaic cells for heating of water in a boiler, which is provided by thermal protection and by a control system.

STATE OF THE ART

Photovoltaic cells use a sunlight energy to produce the direct current, which can be stored in an accumulator, or which can be transformed by inverter to the alternating current for the main power supply.

The photovoltaic cells are not typically used to heat water due to the direct current characteristics of the power supply, which are not compatible with circuit devices such as switches or thermostats, which are intended for alternating current power supply. Previously it was not possible to use the photovoltaic cells, so the direct current, for water heating in compliance with relevant safety requirements for safe operation of boilers.

The aim of the invention is to disclose a new type of the device enables safe water heating by using the energy gained by the photovoltaic panels.

SUMMARY OF THE INVENTION

The above mentioned disadvantages are considerably eliminated by use of the device for regulated water heating using the energy gained by photovoltaic cells it, where it consists of terminals, where to the terminal is brought a protective earth, which is then brought to a thermostat, whereas to the terminal is brought a line conductor of the alternating current, which is then brought to a normally closed contact of a thermal fuse and then the line conductor is brought to a normally closed contact of a thermostat and then the line conductor is brought to a terminal of a coil of the contactor, whereas to the terminal is brought a neutral conductor, which is then brought to a normally closed contact of the thermal fuse and then the neutral conductor is connected to a terminal of the coil of the contactor, whereas to the terminal is brought a conductor of the positive phase of the direct current, which is then brought to a terminal of a switch of the contactor and then the conductor of the positive phase is brought from a terminal of a switch of the contactor to an inlet terminal of a heating coil of the direct current circuit, whereas to the terminal is brought a conductor of the negative phase of the direct current, which is then brought to a second inlet terminal of the heating coil of the direct current circuit.

In an advantageous embodiment the line conductor behind the contact of the thermal fuse is split and brought both to the thermostat and to the additional thermostat, whereas the line conductor is brought from the additional thermostat to an inlet terminal of a heating coil of the alternating current circuit, whereas the neutral conductor behind the contact of the thermal fuse is split and brought both to the terminal of the coil of the contactor and to a second inlet terminal of the heating coil of the alternating current circuit, whereas the protective earth is brought to an additional thermostat.

In another advantageous embodiment between the terminals of the coil of the contactor a signalization is connected.

In another advantageous embodiment between the inlet terminals of the heating coil of the alternating current circuit a signalization is connected.

In another advantageous embodiment between the inlet terminals of the heating coil of the direct current circuit a signalization is connected.

BRIEF DESCRIPTION OF THE DRAWING

The invention will be further explained by use of a drawing, where FIG. 1 is a schematic view of the device for regulated water heating according to the invention.

DETAILED DESCRIPTION OF A PREFERRED EMBODIMENT OF THE INVENTION

Photovoltaic cells are the main source of the direct current. An output of the photovoltaic cells is, e.g., 250 W per panel, i.e., four panels have an output 1 kWh. The photovoltaic cells are connected by conductors to the boiler via a terminal X4 and a terminal X5. A conductor L+ is brought from the terminal X4 to the terminal 1 of a switch of a contactor ST and then the conductor L+ is brought from the terminal 6 of the switch of the contactor ST to an inlet terminal of a heating coil R2. A conductor L− is brought directly from the terminal X5 to a second inlet of the heating coil R2. The output of the heating coil R2 has to be equal to the maximum output of the used photovoltaic cells. The contactor ST has to be designed for switching the direct current to ensure the safety of its operations.

The alternating current is connected to the boiler via a terminal X2 and via a terminal X3, where a line conductor L is connected to the terminal X2 and a neutral conductor N is connected to the terminal X3. A protective earth PE is connected to the terminal X1 and then to a thermostat T1 and to a thermostat T2.

The line conductor L is brought from the terminal X2 to a normally closed contact Y1 of a thermal fuse TP. The line conductor L behind the contact Y1 of the thermal fuse TP is split and directed both to the thermostat T1 and to the thermostat T2. The line conductor L is directed from the thermostat T1 to an inlet terminal of a heating coil R1 and the line conductor L is brought from the thermostat T2 to a terminal A1 of a coil of the contactor ST.

The neutral conductor N is brought from the terminal X3 to a normally closed contact Y2 of the thermal fuse TP. The neutral conductor N, behind the contact Y2 of the thermal fuse TP, is split and directed both to the terminal A2 of the coil of the contactor ST and to a second inlet terminal of the heating coil R1.

If the source of the alternating current is connected to the terminals X2, X3, the contacts 1, 6 of the contactor ST are switched on and the direct current heats the heating coil R2.

If a pre-set temperature of a water is reached, the thermostat T2 breaks the supply of the alternating current to the coil of the contactor ST, which causes opening of the contact of the contactor ST, which causes breaking of the supply of the direct current to the heating coil R2. In the case of failure of the thermostat T2, there is arranged the thermal fuse TP before the thermostat T2, which is able to break the supply of the alternating current into the coil of the contactor ST after reaching the set temperature. By this means full control of water heating carried out by the heating coil R2, so by the direct current, is guaranteed.

In case of lack of sunlight energy and consequently to that, in case of lack of the direct current, water heating is carried out by heating coil R1 supplied by alternating current. If a pre-set temperature of water is reached, the thermostat T1 breaks the supply of the alternating current to the heating coil R1. Heating is terminated.

The signalization of functionality of the contactor ST is provided by signalization S1, which is connected between the terminals A1 and A2 of the coil of the contactor ST.

A heating signalization of the heating coil R1 is provided by signalization S3, which is connected between the inlet terminals of the heating coil R1.

A heating signalization of the heating coil R2 is provided by signalization S2, which is connected between the inlet terminals of the heating coil R2.

The device solves the problem of safeness of water heating by direct current reached by the photovoltaic cells. It enables a new utilization of the photovoltaic cells. Simple installation allows use of the above mentioned device in each house both for domestic and industrial purposes, with a minimal impact to the construction of the building. At the time of lack of sunlight intensity, water heating is provided by gas or other heating source or by use the heating coil R1 supplied by alternating current for that heating. When the sunlight intensity is high, the photovoltaic cells can be use alone. However, the source of the direct current has to be properly dimensioned in dependence on the volume of the boiler. An output 1 kWh of the source of the direct current gained by photovoltaic cells, can be used to heat a water of the volume of 100 L. The estimated minimal durability of the photovoltaic cells is 25 years, whereas the system is able to return the acquisition costs by saving the energy consumption in a period of 2 to 5 years. This makes it an effective investment.

The device for regulated water heating uses energy gained by photovoltaic cells, is able to produce safe and environmental friendly energy just by using a sunlight energy.

What is claimed is:

1. A device for regulated water heating using energy derived from photovoltaic cells, the device comprising terminals (X1, X2, X3, X4, X5), where to the terminal (X1) an electrical ground (PE) is connected, which is then connected to a thermostat (T2), whereas to the terminal (X2) a line conductor (L) of the alternating current is connected, which is then connected to a normally closed contact (Y1) of a thermal fuse (TP) and then the line conductor (L) is connected to a normally closed contact of a thermostat (T2) and then the line conductor (L) is connected to a terminal (A1) of a coil of the contactor (ST), whereas to the terminal (X3) a neutral conductor (N) is connected, which is then connected to a normally closed contact (Y2) of the thermal fuse (TP) and than the neutral conductor (N) is connected to a terminal (A2) of the coil of the contactor (ST), whereas to the terminal (X5) a conductor (L+) of the direct current is connected, which is than connected to a terminal (1) of a switch of the contactor (ST) and than the conductor (L+) brought from a terminal (6) of a switch of the contactor (ST) is connected to an inlet terminal of a heating coil (R2), whereas to the terminal (X5) a conductor (L−) of the direct current is connected, which is then connected to a second inlet terminal of the heating coil (R2).

2. The device of claim 1, wherein the line conductor (L) behind the contact (Y1) of the thermal fuse (TP) is splited and connected both to the thermostat (T2) and to the thermostat (T2), whereas the line conductor (L) brought from the thermostat (T1) is connected to an inlet terminal of a heating coil (R1), whereas the neutral conductor (N) behind the contact (Y2) of the thermal fuse (TP) is splited and connected both to the terminal (A2) of the coil of the contactor (ST) and to a second inlet terminal of the heating coil (R1), whereas the electrical ground (PE) is connected to the thermostat (T1).

3. The device of according to claim 2, wherein between the inlet terminals of the heating coil (R1) a signalisation (S3) is connected.

4. The device of claim 1, wherein between the terminal (A1) and the terminal (A2) of the coil of the contractor (ST) a signalization (S1) is connected.

5. The device of claim 1, wherein between the inlet terminals of the heating coil (R2) a signalisation (S2) is connected.

* * * * *